United States Patent [19]

Takashima

[11] Patent Number: 4,541,971

[45] Date of Patent: Sep. 17, 1985

[54] METHOD FOR THE GUNNING OF REFRACTORIES

[76] Inventor: Masaru Takashima, 4-12-15, Takanawa, Minato-ku, Tokyo, Japan

[21] Appl. No.: 489,457

[22] Filed: Apr. 28, 1983

[51] Int. Cl.[4] ..... F27D 1/16

[52] U.S. Cl. ..... 264/30; 264/269; 264/309

[58] Field of Search ..... 264/30, 269, 309

[56] References Cited

U.S. PATENT DOCUMENTS

| | | | |
|---|---|---|---|
| 1,125,741 | 1/1915 | Schwarz | 264/30 |
| 3,737,489 | 6/1973 | Murton | 264/30 |
| 4,107,244 | 8/1978 | Ochiai et al. | 264/30 |
| 4,248,752 | 2/1981 | Myles | 264/269 |
| 4,268,543 | 5/1981 | Hoffken | 264/30 |

FOREIGN PATENT DOCUMENTS

| | | | |
|---|---|---|---|
| 869082 | 1/1941 | France | 264/309 |

*Primary Examiner*—James Derrington

*Attorney, Agent, or Firm*—Maky, Renner, Otto & Boisselle

[57] ABSTRACT

A method for the gunning of refractories characterized in that a refractory mixture consisting of a refractory aggregate and a binder is mixed in a nozzle with water, and thereafter the admixture is injected toward the working surface, while said nozzle is slidable and rotatable in the range from the vertical to 45° at the angle to the working surface and further it is turnable by 360° to the axis passing its fulcrum.

3 Claims, 3 Drawing Figures

METHOD FOR THE GUNNING OF REFRACTORIES

BACKGROUND OF THE INVENTION

This invention relates to a gunning method in which refractories are suitably coated or filled to construction, vessel and apparatus for which a refractory property is required.

These days unshaped refractories are in quick spread thanks to their effectiveness for the improvement of working efficiency and there are introduced various working methods utilizing vibration, centrifugal force, pressure force, injection, gunning, etc. as well as pouring, and feeding under pressure. Among other things a gunning method holds an important field and there are proposed many improvements for working properties, but there is still left room for further improvements.

For example, the nozzles generally used for apparatus of gunning refractory materials are expendables, and therefore they are of the shape of rectilinear pipe as it is or of the shape in which the end of pipe is bent at an angle of some degree, thus principally being of structure of very simple shape. Moreover, the most nozzles are fixed to a rectilinear pipe connected thereto, so that in gunning refractories by using such nozzles the gunning area is limited to a very narrow one ahead the nozzle and to move the working surface or change the direction of nozzle it is required to change the working position each time.

Accordingly, such gunning method has been very inconvenient and at the same time it has lowered working efficiency as well as being deficient in continuous and homogeneous properties of gunning layers.

As an alternative system there is a gunning method which uses a horizontal type rotary nozzle, but in such case the refractory material is gunned even to other portions than the zone intended to be gunned and this method results in a loss of the refractory material to be uneconomical.

SUMMARY OF THE INVENTION

The present invention is to settle such problems and improve the grade and working property of gunning. It is possible to apply this invention for gunning a refractory where a refractory coating or filling is needed, not to speak of melting furnaces such as blast furnace, converter, electric furnace and reverberatory furnace, vessels for molten metal such as ladle and tundish, vessels for treating molten metals used in Rheinetahl-Hereus process and Dortmund Huettenunion process, various industrial heating furnaces, various accessories and accessory positions of all these furnaces and vessels, and appliances and apparatuses used in accompanying working.

The invention is to provide a method for the gunning of refractories characterized in that a refractory mixture consisting of a refractory aggregate and a binder is mixed in a nozzle with water, and thereafter the admixture is injected toward the working surface, while said nozzle is slidable and rotatable in the range from the vertical to 45° at the angle to the working surface and further it is turnable by 360° to the axis passing its fulcrum.

In carrying out the present invention the nozzle, together with the support members connected thereto, carries out at least one of the advancing, traversing, lifting and turning movements to and the retracting movement from the working surface, and the gunning is possble even if the working surface is plane or curved at any angle from horizontal direction to vertical direction.

The accompanying drawings are schematic views drawings showing a mode of working of the method for gunning a refractory to a vessel for molten metal according to the invention, in which

DETAILED DESCRIPTION OF THE INVENTION

Figure 1:
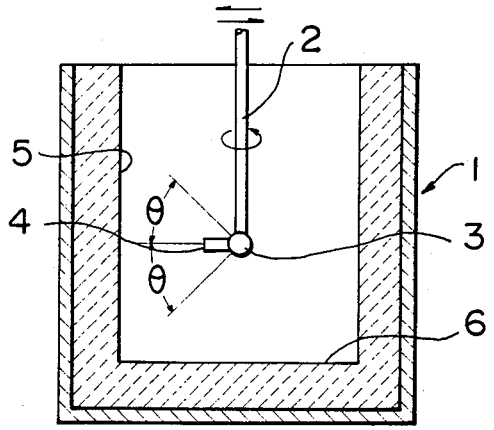
FIG. 1 is a partially sectional side view along the line I—I in FIG. 2.
Figure 2:
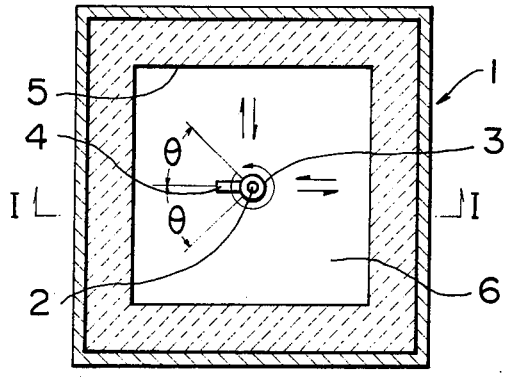
FIG. 2 is a top plan view of FIG. 1.

As shown in the drawings, in case a castable refractory is gunned onto the permanent lining of a vessel (1) for molten metal there is provided a nozzle mechanism which carries out at least one of the advancing, retracting, traversing, lifting and turning movements, and said nozzle mechanism is provided at the end of a support element (2) with a nozzle (4) through a universal joint (3). As shown in FIGS. 1 and 2, the sliding and rotating angle (Θ) to the vertical line to the inside face (5) being the gunning surface of said vessel (1) is up to 45° for said nozzle (4). The method as shown in the drawings provides for sliding and rotating the nozzle such that the nozzle draws a cone, having its apex at the nozzles pivot and its axis normal to the working surface with the included apex angle not exceeding 90°, and also turning the nozzle about an axis perpendicular to the axis of the cone and intersecting the nozzle's pivot.

Figure 3:
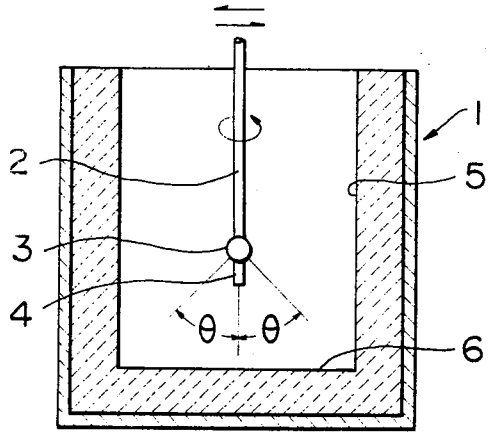
FIG. 3 is a partially sectional side view showing a mode of gunning the bottom surface of said vessel.

Further, in the case of gunning of the bottom surface (6) of said vessel, as shown in FIG. 3, the sliding and rotating angle (Θ) to the vertical line to said bottom surface (6) is up to 45°.

According to the gunning method of the invention, therefore, the nozzle support element carries out at least one of the advancing, retracting, traversing, lifting and turning motions while the nozzle itself slides and rotates in the range up to 45° to the vertical line to the working surface, and therefore it is capable of gunning under optimum conditions to all the working surfaces thereby to obtain homogeneous and strong refractory-coated layers and decrease the loss of gunning refractories.

According to the invention the first feature is such that a refractory mixture consisting of a refractory aggregate and a binder is admixed within a nozzle with water, and therefore the admixture is injected toward the gunning surface. It is for such reason that this system called the nozzle mixing more eliminates the refractory feeding steps and presents more mechanical strength as well as excellent fire and corrosion resistancies than in a system in which a refractory mixture and water are previously fed as a slurry to the nozzle.

Then to take the second feature that the sliding and rotating angle of the nozzle to the working surface is in the range from the vertical to 45° is for such reason that if over this range the refractory adhesivity becomes uneven at the gunning portion corresponding to the outside of the angle formed by the nozzle and the working surface thereby also resulting in increasing the rebound loss. Accordingly, the allowable sliding and rotating range of the nozzle is the peak at the sliding and rotating portion of the nozzle and is limited to a conical range of the vertical angle 90° wherein the perpendicular to the working surface is the center line, and it is beyond the present invention to slide or rotate the nozzle by exceeding said range.

Further to take the third feature that said nozzle is turnable by 360° to the axis passing the nozzle fulcrum while retaining said allowable sliding and rotating range is for such reason that it is possible to make a gunning by turning from the fixed position to the working surface being approximately at the same distance from the nozzle fulcrum, and in combination with the above features the working property for gunning is improved.

In the gunning method carried out by satisfying the above features, by the refractory admixture consisting of a refractory aggregate and a binder is meant everything used as refractory gunning materials and it is possible to optionally select ones which meet the use conditions in operation after gunning.

The turning angle of the nozzle can be changed by connecting the nozzle to the support element through said universal joint and turning a nozzle arm. In such case, it will suffice for the axis if it is the major shaft on an element supporting the nozzle and sometimes it may be a rectilinear pipe which feeds the refractory admixture.

Thus it is optimal for carrying out the present invention to employ, together with the support element to which said nozzle is connected, an automatically operated apparatus having the functions such as advancing, traversing, lifting and turning to or retracting from the working surface. Furthermore, since the subject of carrying out the invention covers a wide range from furnaces, and vessels for molten metal to associated machinery and equipment the working surface covers plane or curved face of various angles ranging from horizontal direction to vertical direction, but the present invention can be optimally carried out for any item thereof.

As described above, the invention relates to a gunning method which jointly uses the nozzle mixing system and the system wherein the turning angle of the nozzle is changeable, so that the obtained refractory-coated layers are strong and homogeneous, and conventional problems can be overcome even in working and economical properties in that the working is simple and the rebound loss is less.

I claim:

1. A method for gunning a refractory coating onto an interior working surface of a vessel, comprising the steps of inserting into the vessel a nozzle carried on a support for universal pivotal movement, mixing a refractory aggregate and a binder with water in the nozzle, ejecting the admixture from the nozzle toward the working surface to be coated, and while mixing and ejecting, sliding and rotating the nozzle such that the nozzle draws a cone having its apex at the nozzle's pivot and its axis normal to the working surface with the included apex angle not exceeding 90°, and also turning the nozzle about an axis perpendicular to the axis of the cone and intersecting the nozzle's pivot.

2. A method as described in claim 1 wherein the nozzle and the support element connected thereto carry out at least one of the advancing, traversing, lifting and turning motions to and retracting motion from the working surface.

3. A method as described in claim 1 wherein the working surface is a plane or curved face at any angle from the horizontal direction to the vertical direction.

* * * * *